US008336740B1

(12) United States Patent
Daansen

(10) Patent No.: US 8,336,740 B1
(45) Date of Patent: Dec. 25, 2012

(54) FLUID DISPENSER AND PUMP ADAPTER SYSTEM THEREFOR

(76) Inventor: Warren S. Daansen, Summerland Key, FL (US)

( * ) Notice: Subject to any disclaimer, the term of this patent is extended or adjusted under 35 U.S.C. 154(b) by 922 days.

(21) Appl. No.: 11/265,646

(22) Filed: Nov. 2, 2005

(51) Int. Cl.
*B67D 7/06* (2010.01)

(52) U.S. Cl. ..... 222/181.3; 222/325; 222/321.17

(58) Field of Classification Search ..... 222/181.3, 222/190, 517, 181.2, 321.7–321.9, 182, 381.1, 222/628, 325, 472, 469
See application file for complete search history.

(56) References Cited

U.S. PATENT DOCUMENTS

| | | | | |
|---|---|---|---|---|
| 3,379,136 | A * | 4/1968 | Corsette | 417/313 |
| 4,277,001 | A * | 7/1981 | Nozawa | 222/321.4 |
| 4,741,461 | A | 5/1988 | Williamson et al. | |
| 4,775,079 | A * | 10/1988 | Grothoff | 222/321.4 |
| 4,974,753 | A * | 12/1990 | Tucker et al. | 222/181.2 |
| 5,033,657 | A * | 7/1991 | Whittington | 222/309 |
| 5,083,678 | A | 1/1992 | Waring | |
| 5,142,610 | A * | 8/1992 | Augustine et al. | 392/442 |
| 5,165,577 | A | 11/1992 | Ophardt | |
| 5,356,039 | A | 10/1994 | Christine et al. | |
| 5,445,288 | A | 8/1995 | Banks | |
| 5,489,044 | A | 2/1996 | Ophardt | |
| 5,497,915 | A | 3/1996 | Wass | |
| 5,595,324 | A | 1/1997 | Brown et al. | |
| 5,638,989 | A | 6/1997 | Ophardt et al. | |
| 5,855,302 | A * | 1/1999 | Fisscher | 222/207 |
| 5,941,428 | A * | 8/1999 | Behar et al. | 222/321.7 |
| 6,045,006 | A * | 4/2000 | Frazier et al. | 222/105 |
| 6,053,370 | A * | 4/2000 | Ludbrook et al. | 222/207 |
| 6,082,586 | A | 7/2000 | Banks | |
| 6,126,042 | A * | 10/2000 | Meshberg | 222/321.4 |
| 6,131,773 | A * | 10/2000 | Wade et al. | 222/153.02 |
| 6,216,916 | B1 | 4/2001 | Maddox et al. | |
| 6,223,944 | B1 | 5/2001 | Gehl et al. | |
| 6,250,833 | B1 | 6/2001 | Perry et al. | |
| 6,334,449 | B1 * | 1/2002 | Burrowes et al. | 132/114 |
| 6,364,172 | B1 | 4/2002 | Maas et al. | |
| 6,394,315 | B1 | 5/2002 | Banks | |
| 6,409,050 | B1 | 6/2002 | Ophardt et al. | |
| 6,439,431 | B1 | 8/2002 | Breault et al. | |
| 6,543,653 | B2 | 4/2003 | Lamboux | |
| 6,601,736 | B2 | 8/2003 | Ophardt et al. | |

(Continued)

FOREIGN PATENT DOCUMENTS

DE 2727679 * 11/1978

(Continued)

OTHER PUBLICATIONS

Kaiser (DE 2 727 679) translation.*

*Primary Examiner* — Kevin P Shaver
*Assistant Examiner* — Robert Nichols, II
(74) *Attorney, Agent, or Firm* — McLane, Graf, Raulerson & Middleton, Professional Association

(57) ABSTRACT

The present disclosure relates to a fluid dispenser of a type having a housing in which a container filled with a fluid to be dispensed is removably received. The container incorporates a pump and an adapter assembly for securing the pump within an opening or fitment of the container and for removably securing the container within the housing. In another aspect, an improved push bar-type actuator is provided. In certain embodiments, an angled receptacle for receiving the pump and adapter receptacle is provided for ease of emplacing the container within the housing.

17 Claims, 12 Drawing Sheets

U.S. PATENT DOCUMENTS

| | | | | |
|---|---|---|---|---|
| 6,607,097 | B2 | 8/2003 | Savage et al. | |
| 6,612,468 | B2 | 9/2003 | Pritchett et al. | |
| 6,666,355 | B2 | 12/2003 | Padar | |
| 6,712,241 | B1 | 3/2004 | Garcia et al. | |
| 6,722,530 | B1 | 4/2004 | King et al. | |
| 6,814,262 | B1 | 11/2004 | Adams et al. | |
| 6,877,642 | B1 | 4/2005 | Maddox et al. | |
| 6,997,352 | B2 * | 2/2006 | Sallows et al. | 222/105 |
| 7,011,237 | B1 * | 3/2006 | Sayers et al. | 222/321.9 |
| 7,198,177 | B2 * | 4/2007 | Ganzeboom | 222/321.8 |
| 2004/0232168 | A1 * | 11/2004 | Ciavarella et al. | 222/156 |
| 2004/0232175 | A1 | 11/2004 | deCler et al. | |
| 2004/0251273 | A1 | 12/2004 | Brown et al. | |
| 2005/0051579 | A1 * | 3/2005 | Kasting | 222/321.7 |
| 2005/0087552 | A1 | 4/2005 | Ciavarella et al. | |
| 2005/0087563 | A1 | 4/2005 | Ciavarella et al. | |
| 2005/0087564 | A1 * | 4/2005 | Marelli | 222/321.9 |
| 2005/0224519 | A1 * | 10/2005 | Law et al. | 222/190 |
| 2005/0263545 | A1 * | 12/2005 | Ophardt | 222/477 |
| 2005/0284888 | A1 * | 12/2005 | Rhodenbaugh et al. | 222/181.3 |
| 2006/0163288 | A1 * | 7/2006 | Su | 222/321.2 |
| 2007/0068971 | A1 * | 3/2007 | Garcia et al. | 222/321.7 |
| 2007/0251953 | A1 * | 11/2007 | Criswell et al. | 222/105 |

FOREIGN PATENT DOCUMENTS

| | | | |
|---|---|---|---|
| DE | 2727679 | A * | 11/1978 |

* cited by examiner

FLUID DISPENSER AND PUMP ADAPTER SYSTEM THEREFOR

BACKGROUND OF THE INVENTION

The present disclosure relates to a fluid dispenser of a type having a housing in which a container filled with a fluid to be dispensed is removably received. The container incorporates a pump and an adapter assembly for securing the pump within an opening or fitment of the container and for removably securing the container within the housing. In another aspect, an improved push bar-type actuator for communicating movement to the pump is provided. In certain embodiments, an angled receptacle for receiving the pump and adapter receptacle is provided for increased ease of emplacing the container within the housing.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
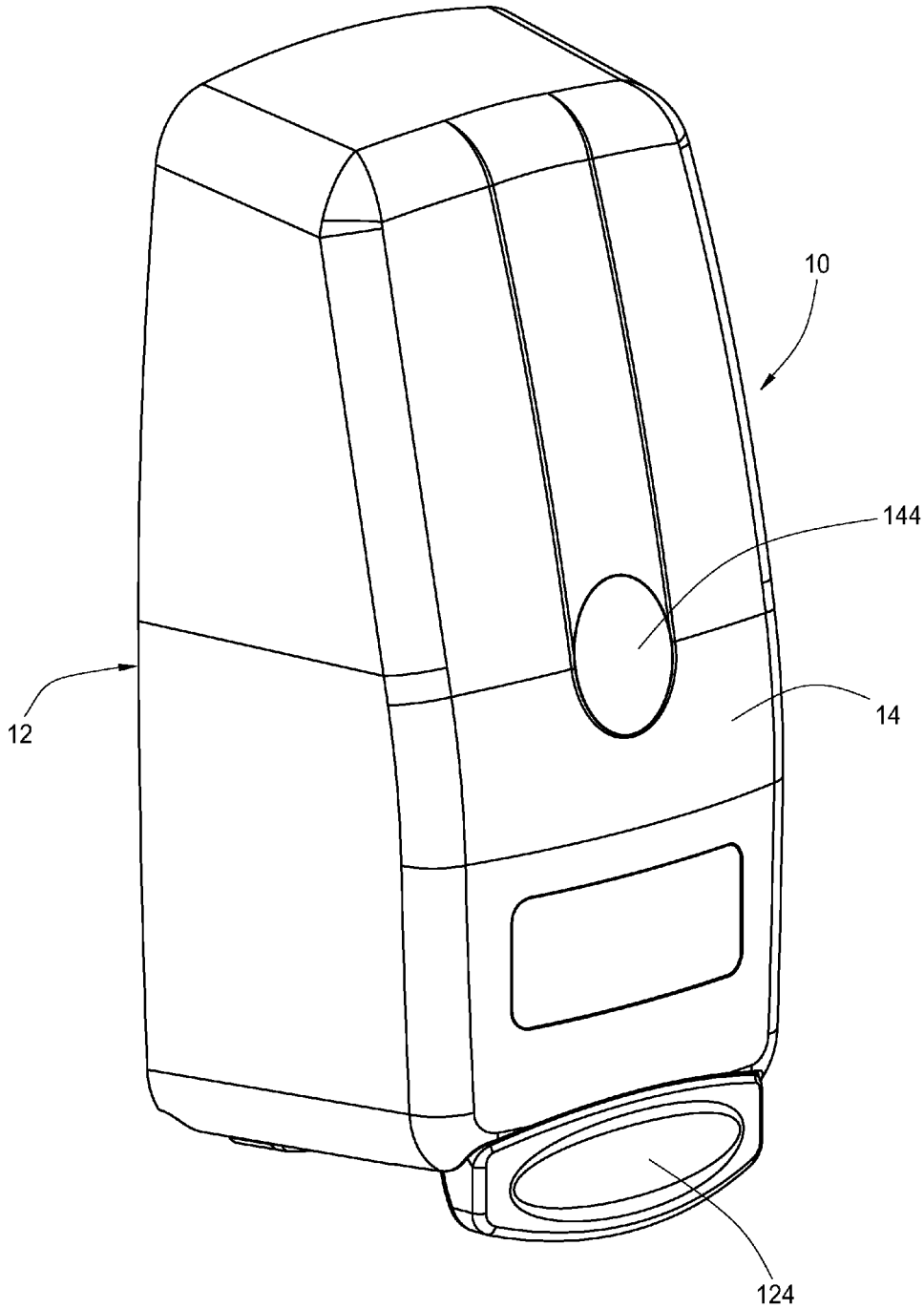
FIG. 1 is a perspective view of a fluid dispenser in accordance with an exemplary embodiment of the present invention.

In reference to the drawing figures, wherein like reference numerals refer to like or analogous components throughout the several views, FIGS. 1-7 show a fluid dispenser, indicated generally by the numeral 10. The dispenser 10 is preferably a soap dispenser, and more preferably, a dispenser which dispenses a soap in the form of a foam, and will be shown and described herein primarily by way of reference thereto. However, it will be appreciated that the present invention is also amenable to all manner of dispensable fluids, including without limitation, cosmetic products such as lotions, creams, shampoos, body washes, hand sanitizers, wound care, medical applications, and the like, food products such as sauces and the like, and other flowable materials.

The dispenser 10 includes a housing 12 including a front section or cover 14 and a rear section 16 which join together to define an interior compartment 18. A container assembly

Figure 2:
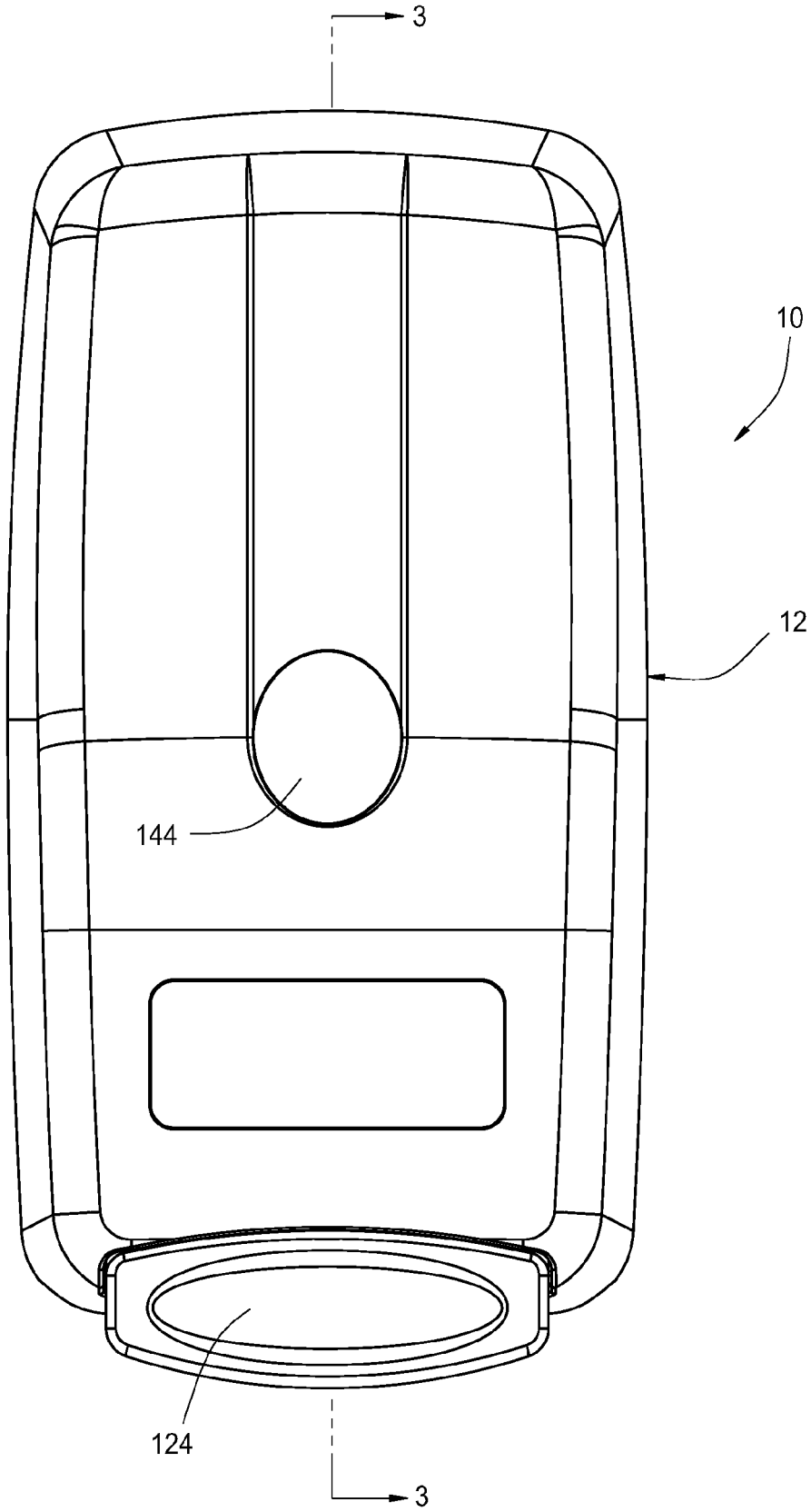
FIG. 2 is a front elevational view thereof.
Figure 3:
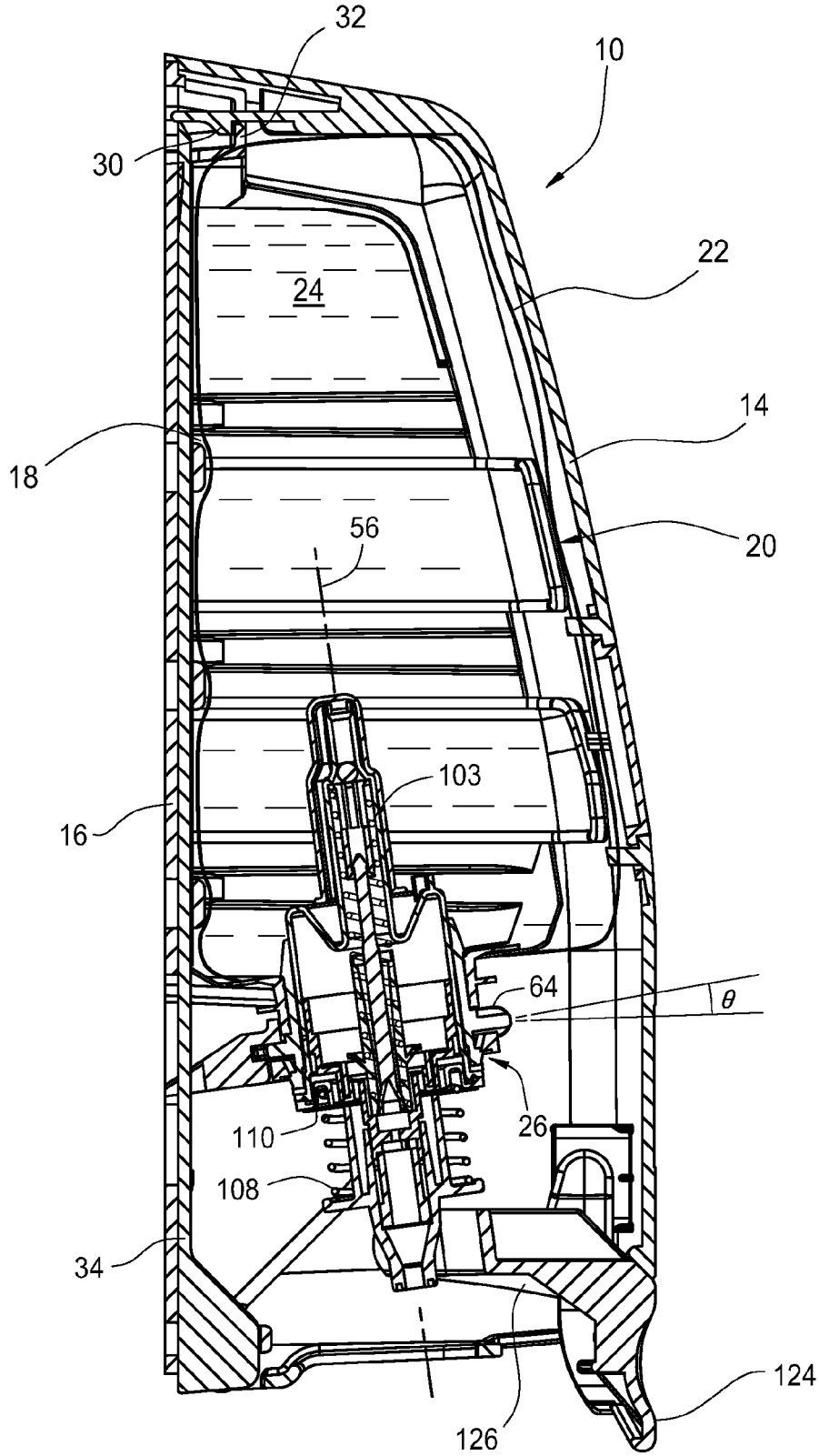
FIG. 3 is side-sectional view taken along the lines 3-3 shown in FIG. 2.
Figure 4:
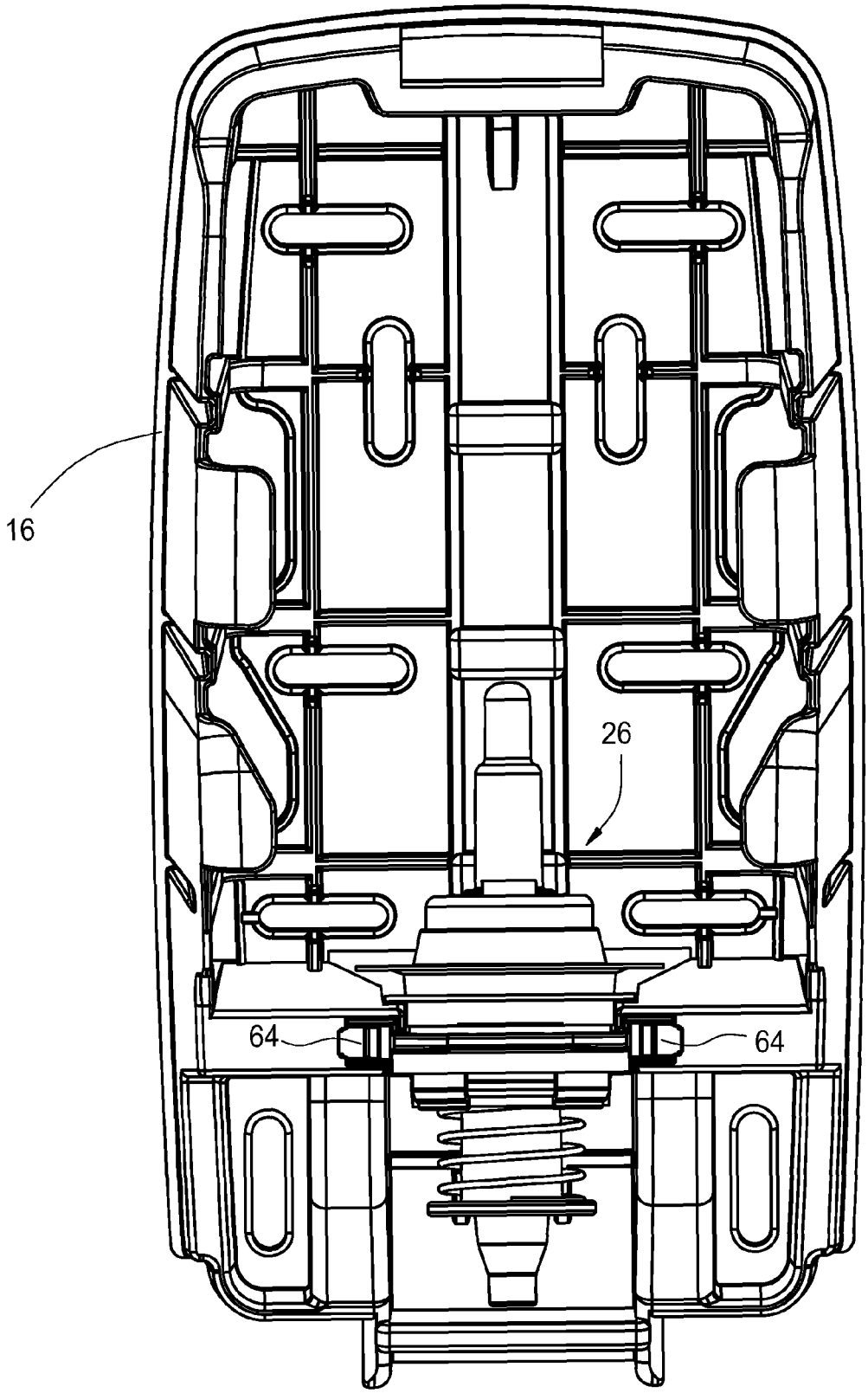
FIG. 4 is a front elevational view thereof with the housing front cover removed and showing the housing base with the pump mounted therein.
Figure 5:
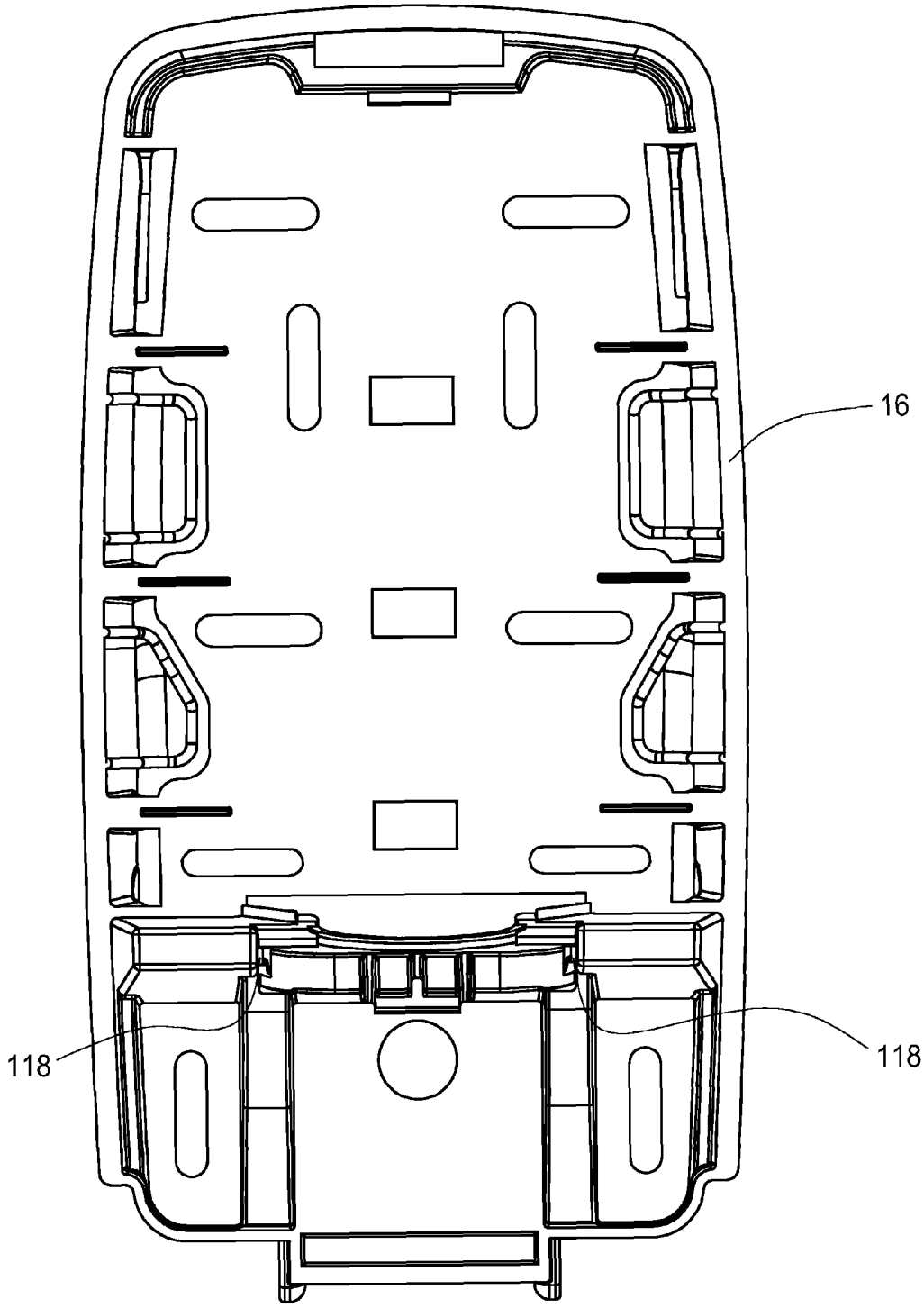
FIG. 5 is a rear elevational view thereof.
Figure 6:
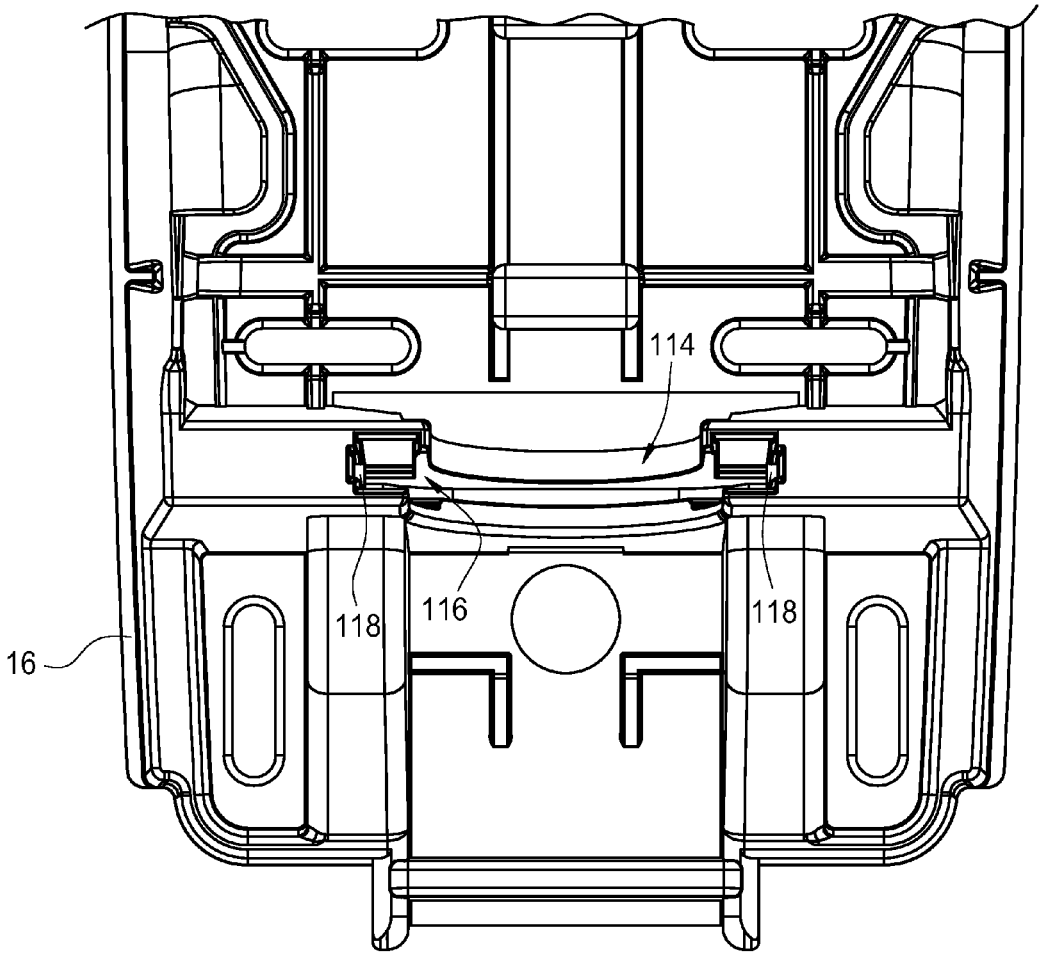
FIG. 6 is an enlarged, fragmentary rear view thereof.
Figure 7:
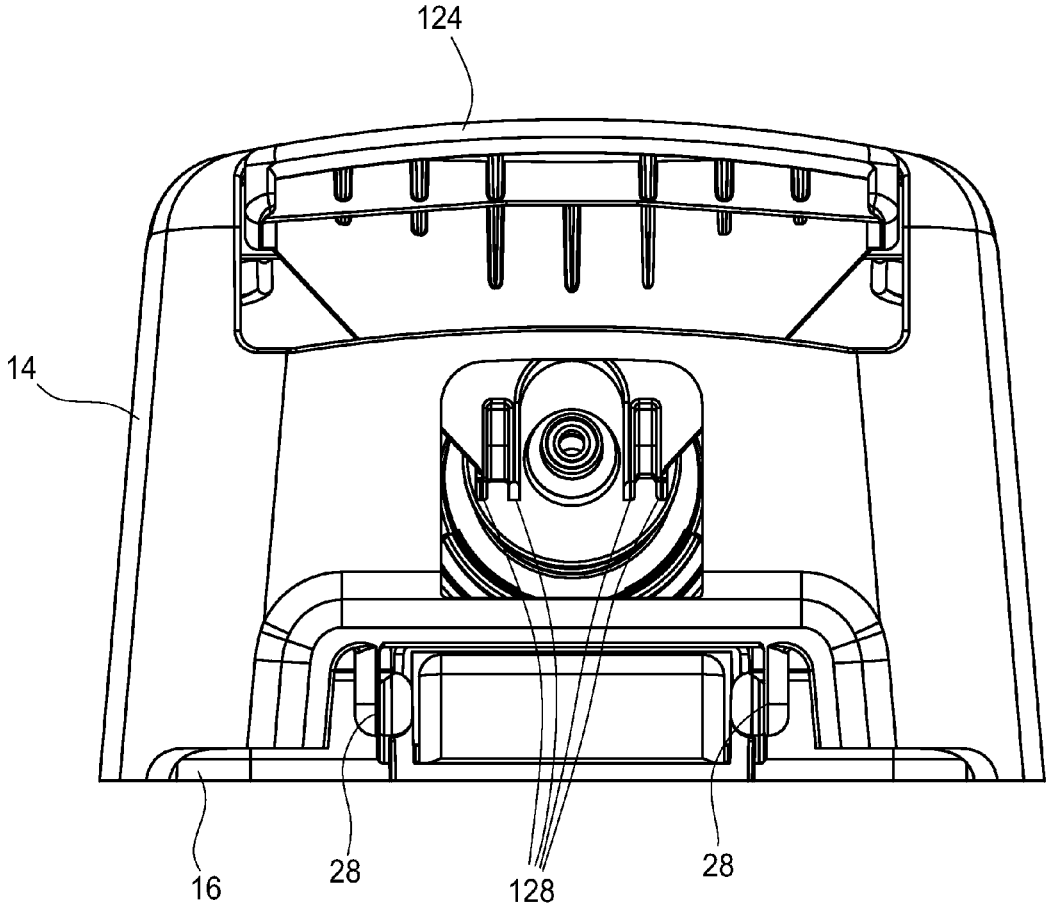
FIG. 7 is a bottom plan view thereof.

20 includes a container member such as a flexible bag or bottle 22 containing soap or other product to be dispensed 24 and an integrated pump and adapter assembly 26, and is received within the interior compartment 18 defined by the housing section halves 14 and 16. As used herein, unless indicated otherwise, terms indicating relative position or orientation such as front, rear, upper, lower, horizontal, vertical, etc., refer to the dispenser in the operable, upright (e.g., wall-mounted) position, as shown in FIG. 2. Reference the axial direction is intended to mean the longitudinal axis 56 of the pump and adapter assembly 26 as shown in FIGS. 3 and 9, unless otherwise stated.

The rear section 16 is adapted to be attached to a vertical wall, e.g., via threaded fasteners, adhesive fasteners, or the like. The front housing section 14 is hingedly attached to the rear housing section 16 via pivoting connections 28. The front section 14 pivots between a closed or latched position as shown in FIGS. 1-3 and an open position for removal and replacement of an empty container assembly 20. A latch member 30 on the front shell 14 engages a catch 32 formed on the rear member 16 to secure the dispenser in the closed position. A latch bar 34 is slidingly secured to the rear housing 14 and is manually slidable in the vertical direction to disengage the latch member 30 from the catch 32. Alternatively, other latching or locking arrangements, such as a lock requiring a key to access the interior of the dispenser may be employed, as are generally known in the art. The interior surfaces of the housing sections may have various shelves, bosses, ribs, or the like to receive and support the bag 22 within the interior compartment of the dispenser housing 12.

Figure 9:
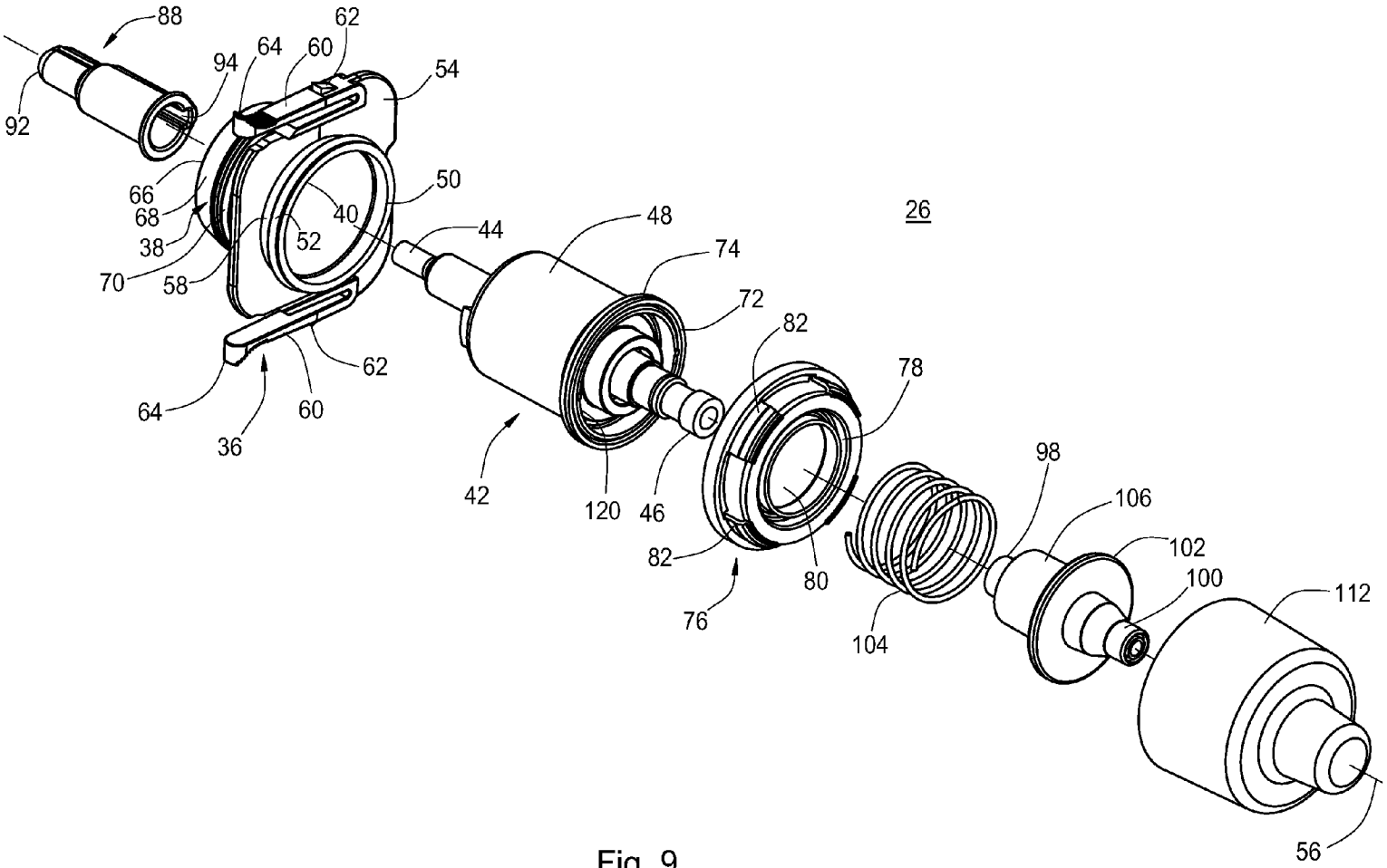
FIG. 9 is an exploded view of the pump and adapter assembly.
Figure 12:
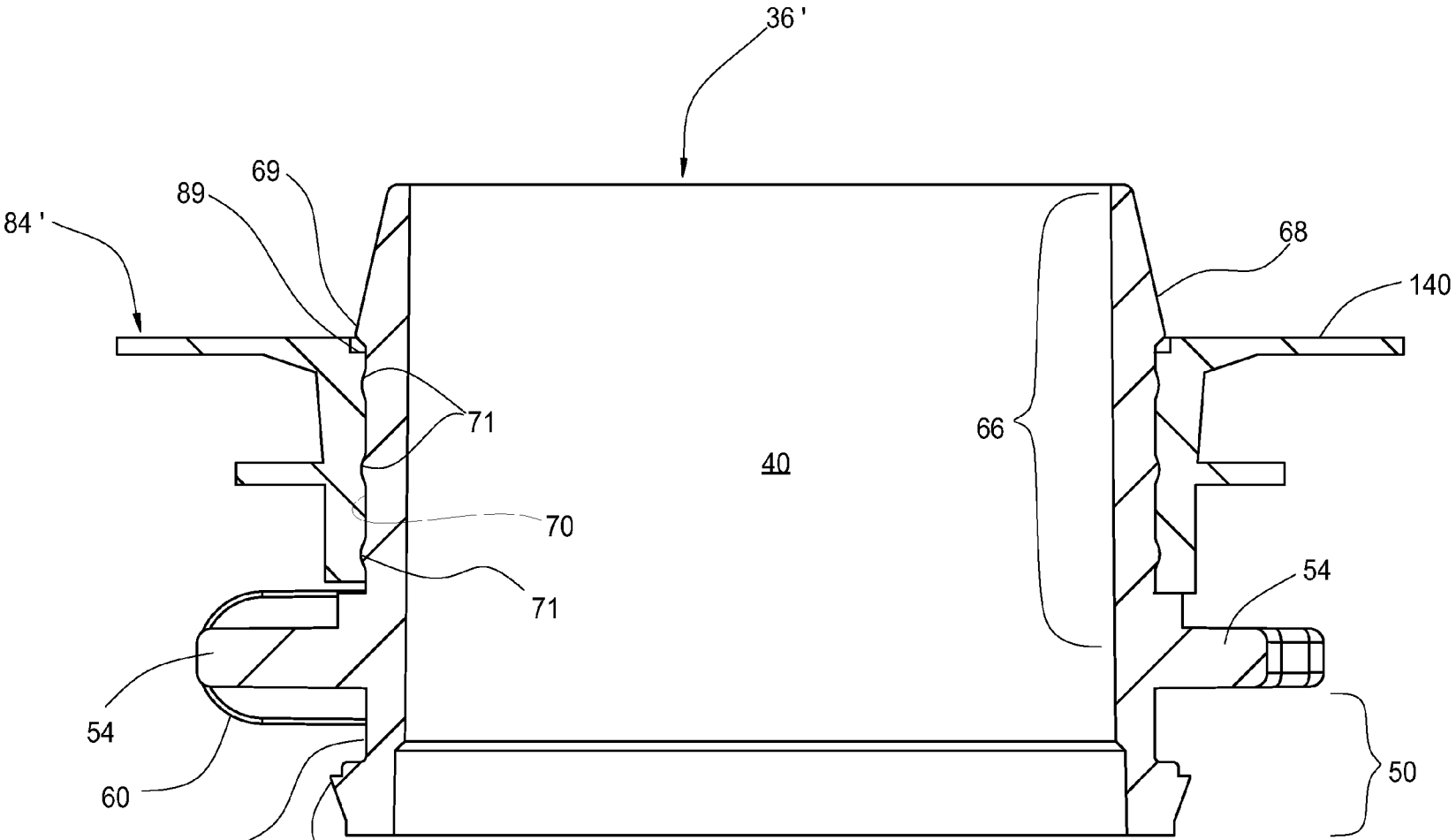
FIG. 12 is cross-sectional view of an alternative mating adapter ring and product container fitment in accordance with an alternative embodiment of the invention.

As best seen in FIG. 9, the pump assembly 26 includes an adapter member 36 having a sleeve 38 defining an axial opening 40 for receiving a pump 42. The pump 42 includes an inlet 44, an outlet 46, and a main body 48. The opening 40 receives the main body 48 of the pump 42. A lower end 50 of the sleeve 38 forms a lip 52. A flange 54 lies in a plane transecting a longitudinal axis 56 of the pump assembly 26. The flange 54 is axially spaced from the lip 52 to define an annular channel 58 therebetween. The flange 54 includes a pair of resilient spring arms 60, each having a latch 62 and a distal end 64. An upper end 66 includes an annular lip or ridge 68 and an annular channel 70 axially adjacent thereto. Alternatively, the upper end 66 may include an annular lip and some number of annular ribs for providing a water-tight, friction fit with the container as shown in FIG. 12 and described in greater detail below.

In the depicted embodiment, the pump 42 is a foam-dispensing pump of a type as shown and described in U.S. Pat. No. 6,053,364, which is incorporated herein by reference in its entirety. However, it will be recognized that the present invention may be adapted for use in connection with any other type of foaming or non-foaming pump engine which utilizes relative axial movement, e.g., telescoping or piston-type movement, between pump components.

When assembled, the main body 48 of the pump 42 is received in the opening 40 such that the lower edge 50 of the sleeve 38 abuts a flange 72 formed on the pump 42. A sealing ring 74 may be provided between the edge 50 and the flange 72 to prevent fluid flow therebetween. A retaining ring 76 includes a radially inwardly extending portion 78 defining an axial opening 80 receiving pump outlet 46. A single or plurality of latching members 82 are radially spaced about the axis 56 and engage the axial channel 58 when assembled, thereby capturing the flange 72 and optional sealing ring 74 between the lip 52 and the inwardly extending portion 78 in clamping fashion. The latch members 82 and the lip 52 may have facing and generally aligned inclined surfaces so as to facilitate relative axial movement when the components are being fastened but to resist separation once the retaining ring 42 is connected to the sleeve 38, i.e., when the latching members 82 are received in the axial channel 58.

The depicted pump and adaptor system embodiment 26 allows a portion of the pump 42 to be contained within the bag 20, which allows external dimensions of the dispenser to be kept to a minimum, including the height of the dispenser and, in the depicted preferred embodiment having an angled receptacle as described in greater detail below, the distance the dispenser protrudes from the wall.

The upper end 66 of the sleeve 38 is snap fit to a flanged spout or fitment member 84 provided on the container bag 22. The fitment member 84 includes a radially inwardly extending lip 86 which engages the annular groove 70 when the connector end 66 is received in the fitment 84. The radially outward facing surface of the lip 68 and/or the radially inward facing surface of the lip 86 may be inclined to facilitate axial relative movement during insertion but to resist separation after the pump assembly 26 is secured to the bag 22, i.e., when the lip 86 has engaged the channel 70.

With additional reference to FIG. 12, there is shown an alternative adapter ring 36' and container fitment 84' configuration. The adapter ring 36' includes an upper sleeve portion 66 and a lower sleeve portion 50 on opposing sides of a flange area 54 having spring arms 60 as described above. The lower sleeve 50 includes a tapered portion 52 adapted to engage a retaining ring as detailed above. The upper sleeve portion includes a tapered end 68 defining a radially outwardly extending lip or shoulder 69 and an annular channel 70 axially adjacent thereto.

When the sleeve portion 66 engages the spout portion of the fitment 84', the shoulder 69 engages a complimentary annular notch 89. The surface 68 is inclined to facilitate passage of the lip 69 into the channel 80 as the sleeve 66 is inserted into the fitment 84', but to resist separation of the sleeve 66 from the fitment 84' after the members 36' and 84 are engaged. Annular protrusions 71, such as sealing rings, pressure ribs, etc., may be provided on the radially outward facing surface of the sleeve portion 66 to increase the sealing or friction interference between the sleeve 66 and the fitment 84'. Alternatively, in an embodiment not shown, the annular pressure or sealing rings or ribs may be provided on the radially inward facing surface of the fitment 84' spout.

A dip sleeve 88 may also be provided in place of the conventional dip tube commonly employed with such pumps. The dip sleeve 88 is open at a first end 90 and closed at the opposite end 92. The dip sleeve 88 defines an axial bore and includes one or more axially-extending channels or grooves 94 defined on the inward surface thereof. The dip sleeve 88 is fit over the pump inlet 44, e.g., via friction fit, snap fit, or the like. The interior longitudinal channels 94 provide a passageway which allows the soap to be drawn along the interior of the dip sleeve 88 and into the pump inlet 44. Since the pump is operated in a substantially inverted in operation, the dip sleeve 88 provides a flow passageway between the bottom of the container bag 22 and the pump inlet 44. This effectively lowers the height of the pump inlet, allowing more of the soap product 24 to be withdrawn from the bag 22, and thereby decreasing waste.

A nozzle 96 includes an upper end 98 which is fit over the pump outlet 46, e.g., via friction fit, snap fit, or the like, and a lower end 100 defining a dispensing outlet. The nozzle 96 defines an axial bore which extends the flow passageway of the pump 42 to the outlet 100. A flange 102 is provided between the nozzle upper end 98 and the nozzle lower end 100. A coil spring 104 is received coaxially about the nozzle 96. An upper end of the spring 104 bears against the inwardly extending surface 78 of the retaining ring 76. A lower end of the spring 104 bears against the flange 102. The nozzle 96 may include an enlarged diameter portion 106 to maintain the spring 104 in an axially centered position. The upward facing surface of the flange 102 may include an annular groove or channel 108 for seating the lower end of the spring 104. Likewise, the inwardly extending portion 78 of the retaining ring 76 may include an annular groove or channel 110 for seating the upper end of the spring 104. A removable cover 112 may be provided over the nozzle outlet 96 to protect the pump outlet and prevent inadvertent discharge or leakage during handling, transport, and storage. The cover 112 is removed prior to installation of the container/pump assembly 20 into the dispenser 10.

In the depicted embodiment, the spring 104 is generally cylindrical, which may result in coil stacking as the spring is compressed during pump actuation. Spring coil stacking may limit the distance the spring can compress which, in turn, may tend to limit the range of relative axial movement which may be communicated to the telescoping pump components. In the depicted embodiment, the problem of coil stacking is alleviated by the channel 110, which is of sufficient axial extent so as to accommodate stacked coils as the spring is compressed during actuation. Alternatively, a generally conical coil spring may be employed to prevent coil stacking when the spring is compressed and thereby increase the axial extent of spring compression.

The rear housing member 16 includes a nest or receptacle 114 formed therein for receiving the pump assembly 26. The nest 114 includes a slot 116 for receiving the flange 54 and spring arms 60 of the adapter member 36. The slot 116 includes a pair of catch points 118 which engage the protrusions 62 on the spring arms 60. Each of the protrusions include an inclined or tapered surface to facilitate movement past the catch points 118 during installation of the container pump assembly 20 in the housing member 16 while providing positive retention of the adapter member 38 in the slot 118. The distal ends 64 of the spring arms 60 are manually accessible when the cover housing member 14 is in the open position. In removing the container/pump assembly 20, e.g., after the container 22 is depleted, the distal ends 64 of the spring arms 60 are compressed whereby the protrusions 62 are disengaged from the catch points 118, allowing the unit to be withdrawn from the nest. A new container/pump unit 20 may then be inserted.

Figure 8:
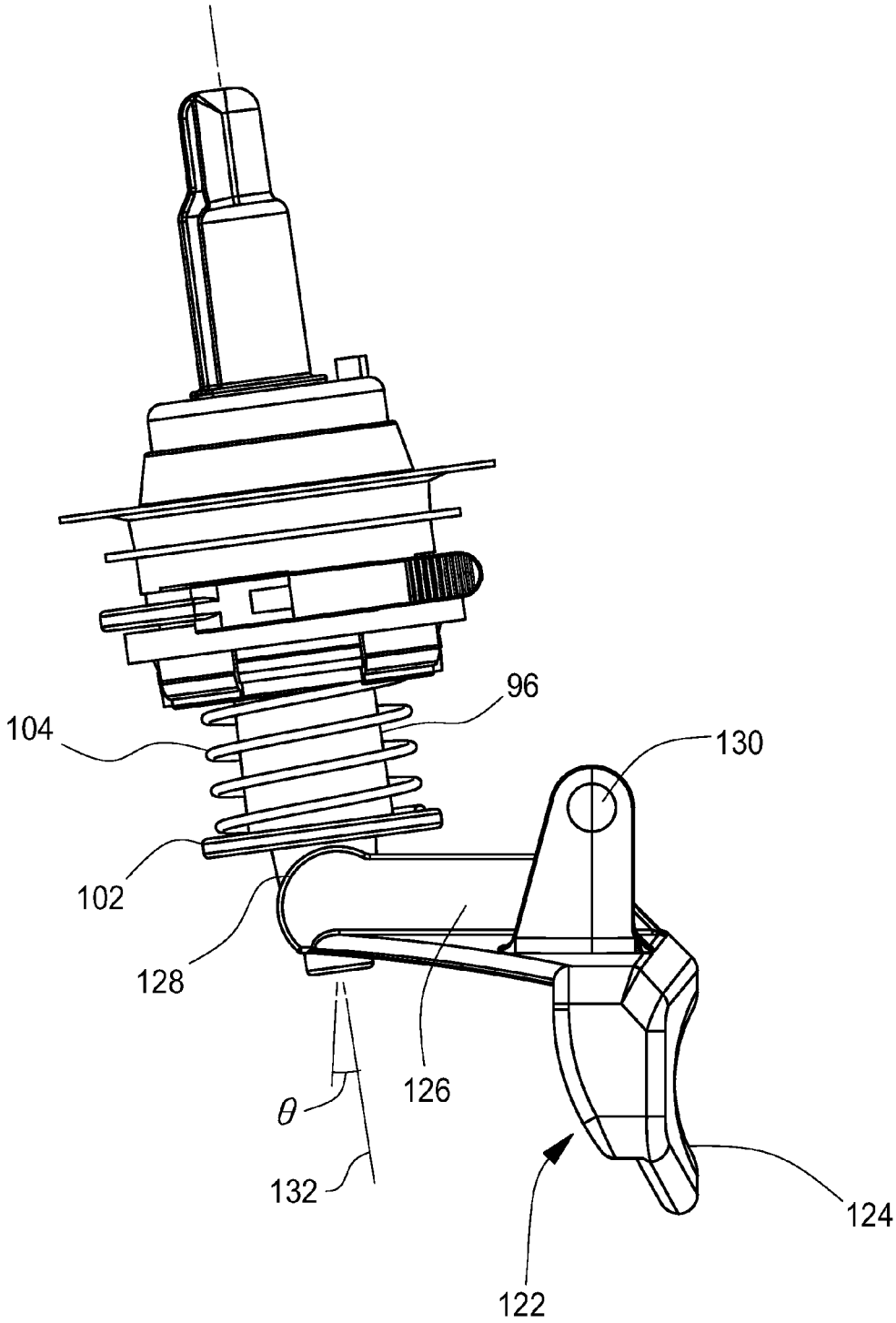
FIG. 8 illustrates an embodiment of a pump and push bar pump actuator.

As noted above, the pump 42 may be of any type which is actuated by relative axial movement between pump components. In operation, the pump outlet 46 and internal piston component 120 are axially movable relative to the pump body housing 48. As best seen in FIG. 8, a push bar member 122 includes a manually depressible lever portion 124 and lever arms 126 with cam surfaces 128. The push bar member 122 is pivotable about a pivot point 130. In operation of the dispenser 10, the manually depressible lever 124 pivots about the pivot axis 130 when depressed by a user. The cam surfaces 128 of the lever arms 126 bear against the flange 102 against the urging of the spring 104. The cam surfaces 128 are shaped such that the point of contact between the cam surface 128 and the flange 102 remains substantially aligned with the centerline, indicated by numeral 132, of the pump 42 during rotational movement of the lever arm 126. In this manner, sticking or jamming of the telescoping pump components, which may result from eccentric or off-axis loading of the nozzle 96, is prevented or reduced.

As the nozzle assembly 96 is moved upwardly, a charge of product 24 contained in the pump is dispensed via the outlet 100. When the lever 124 is released, the spring 104 bears against the flange 102 and assists in the return of the pump to the closed position. During the return movement, the next charge of product 24 to be dispensed is drawn from the bag 22 into the pump 42. It will be recognized that dispenser pumps will commonly employ an internal spring 103 to urge the pump to the closed state after actuation, and thus the external spring 104 is optional. However, such springs tend to be smaller and the use of a supplemental external spring 104 is preferred to ensure complete closure of the pump after a dispensing operation.

Prior art dispensers employing axially displaceable pumps have typically incorporated an additional, spring loaded linkage movable in the axial direction as a permanent part of the dispenser housing. This spring-loaded mechanism captures the pump nozzle and transmits movement thereto. In such prior art solutions, the push bar bears against the spring-loaded linkage which in turn actuates the captive pump nozzle. By way of contrast, the pivoting push bar 122 of the present disclosure bears directly against the pump nozzle 96. In this manner, there is no need for an additional linkage for the capture and operation of the pump nozzle. Instead, the actuator 122 of the dispenser is non-spring loaded, thereby simplifying the dispenser housing and reducing the cost of its manufacture and the likelihood of its malfunction.

As noted above, the pump is generally inverted when placed in the operative position. In the depicted preferred embodiment, the slot 116 of the nest 114 lies at an angle θ with respect to horizontal. It has been found that angling the nest 116 upward toward the front of the dispenser (i.e., upward toward the operator) facilitates placing and seating the pump assembly 26 in the nest 114. The angle θ may be up to about 45 degrees and is preferably in the range of from about 5 degrees to about 30 degrees and more preferably in the range of about 7.5 degrees to about 15 degrees. In alternative embodiments, it is contemplated that the slot 116 receiving the adapter ring flange 54 may be configured horizontally such that the pump axis 56 lies in a true vertical position.

In certain embodiments, a mating or keyed relationship may be provided between the pump assembly 26 and the dispenser nest 114. For example, the adapter ring 36 may include one or more recesses, notches, or the like, e.g., formed on the flange portion 54 and aligned with and receiving one or more complimentary shaped protrusions in the nest 114 when the container 20 is installed in the dispenser unit 10. Alternatively or additionally, one or more key projections may be provided on the adapter ring which mates with corresponding complimentary receivers in the nest 114. Such keyed arrangements may vary in terms of, for example, the number of protrusions/receivers, the shape of protrusions/receivers, the position of the protrusions/receivers, and combinations thereof. Such keyed arrangements ensure that the appropriate containers 20 are matched with the appropriate or desired dispenser units 10.

Figure 10:
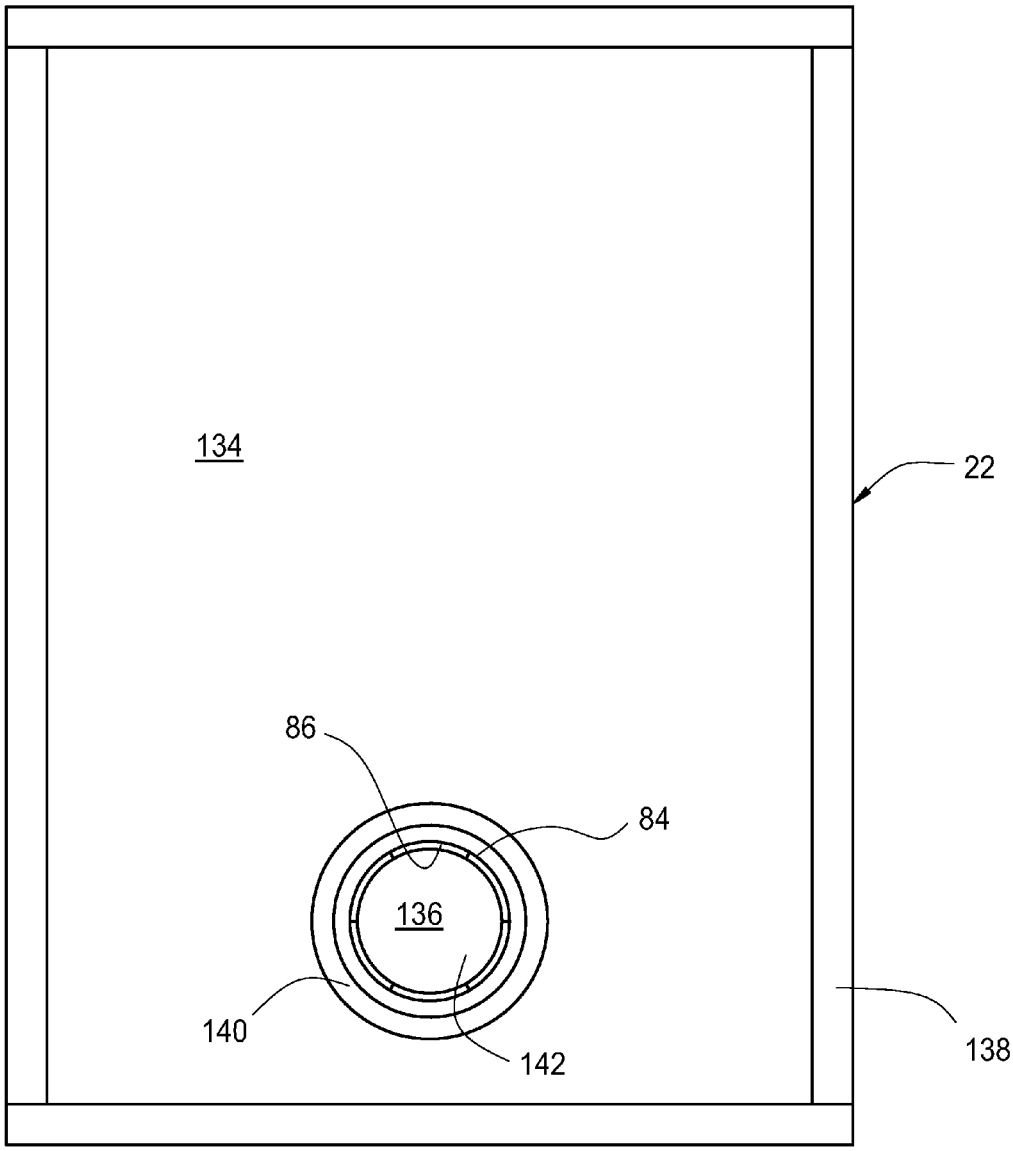
FIG. 10 is a top plan view of an exemplary bag for use with the pump and adapter assembly.
Figure 11:
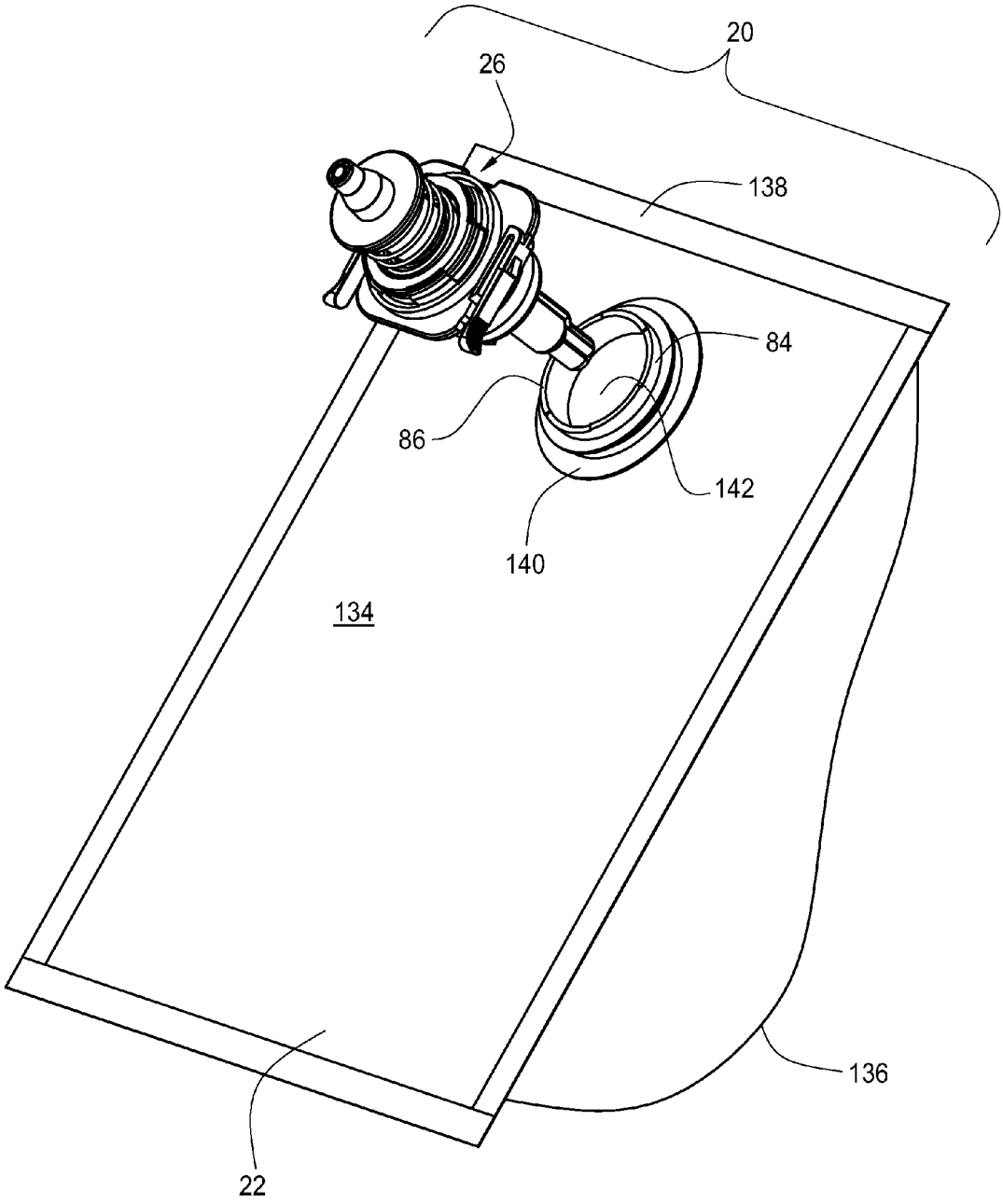
FIG. 11 is an exploded view of the bag and pump/adapter assembly.

FIGS. 10 and 11 shows an exemplary bag 22, which may be formed of a plurality of layers of sheets of material. In the depicted embodiment, the container is formed of opposing sheets 134 and 136, of flexible material preferably plastic, bounded by a peripheral seam or seal 138. It will be recognized that alternatives variations of the container bag are possible. For example, more than two layers of material may be employed. Alternatively, the seam or seams could be placed differently, e.g., on the front, the back, the top, the bottom, and so forth. The seal 138 may be formed via heat sealing or the like. Likewise, the spout 84 includes a flange 140 which is fastened about an opening 142 on the upper sheet 134, e.g., via heat sealing or the like. In manufacturing the container/pump assembly 20, the bag 22 is first filled with the product to be dispensed and pump and adapter assembly 26 is secured to the spout 84, e.g., via a snap fit connection between the spout lip 86 and the adapter ring sleeve 38 as detailed above. Preferably, the plastic material is transparent or translucent to allow transvisualization of the product remaining in the bag 22, e.g., for the purpose of determining whether the product in the container 22 has been exhausted and in need of replacement. To this end, a transparent or translucent window 144 may be provided in the housing shell 14. It will be recognized that, in the present configuration, venting of the container 22 is unnecessary since pressure in the bag is maintained as the bag collapses upon itself. In alternative embodiments, the flexible bag 22 could be replaced with a collapsible plastic bottle or by a vented, (e.g., refillable) bottle.

The invention has been described with reference to the preferred embodiments. Modifications and alterations will occur to others upon a reading and understanding of the preceding detailed description. It is intended that the invention be construed as including these and other modifications and alterations.

The invention claimed is:

1. A dispenser for dispensing fluids from a collapsible container of a type having a pump attached thereto, the pump being of a type which is actuated by axial displacement of an outlet nozzle along a longitudinal axis of the pump, said dispenser comprising:

a rear housing section adapted to be attached to a vertical wall;

a front housing section pivotally attached to said rear housing section and movable between an open position and a closed position;

a push bar pivotally carried on said front housing section;

a generally U-shaped lever arm connected to said push bar, said lever arm having two spaced apart bearing members, each bearing member having a proximal end secured to said push bar and a distal end having a bearing surface bearing against the outlet nozzle and transmitting axial movement to the outlet nozzle in response to pivotal movement of said push bar when the pump is received in the nest, the bearing surface having a cammed shape such that a point of contact between the bearing surface is aligned with a centerline of the pump, wherein said point of contact remains substantially aligned with said centerline during pivotal movement of said push bar to reduce off-axis forces on the nozzle, the distal ends of said bearing members having an opening therebetween allowing the pump to pass therebetween when the pump is received in said nest and said front housing section is moved from the open position to the closed position, and wherein said push bar and said lever arm are moved out of operational contact with the pump when the pump is received in said nest and said front housing section is in the open position;

a nest formed in the rear housing section for removably receiving the pump in an inverted orientation, said nest including an inclined slot for receiving a portion of the pump, said inclined slot inclined upward toward said front housing section at a first angle ranging from about 5 degrees to about 30 degrees relative to horizontal when said dispenser is mounted in a vertical, operational orientation, whereby the longitudinal axis of the pump is inclined rearward toward an upper end of said dispenser at a second angle ranging from about 5 degrees to about 30 degrees relative to vertical when said dispenser is mounted in a vertical, operational orientation; and said push bar having a manually depressible portion which extends in a generally vertical direction from a lower end of the front housing section when said dispenser is mounted in a vertical, operational orientation wherein, during operation, horizontal movement of a user's hand on the manually depressible portion is translated by said push bar and said lever arm into movement in the direction of the pump axis, wherein, the user's hand is moved into alignment with the outlet nozzle of the pump, thereby allowing one-handed operation by the user.

2. The dispenser of claim 1, wherein said first angle is about 7.5 degrees and said second angle is about 7.5 degrees.

3. The dispenser of claim 1, wherein the fluid to be dispensed is liquid soap.

4. The dispenser of claim 1, wherein the fluid to be dispensed is liquid soap admixed with air in the form of a foam.

5. The dispenser of claim 1, wherein the collapsible container includes a plurality of flexible sheets sealed along a periphery to define an interior of the collapsible container and a fitment defining an opening in said collapsible container.

6. The dispenser of claim 1, further comprising:

the pump removably received in said nest.

7. The dispenser of claim 6, further comprising:

an adapter assembly connecting the pump to the collapsible container; and said inclined slot removably receiving an enlarged diameter portion of the adapter assembly.

8. The dispenser of claim 6, further comprising:

said pump having an inlet, an outlet, a main body, and a nozzle including a nozzle flange attached to the outlet, wherein said nozzle, nozzle flange, and longitudinal axis are coaxial;

an adapter ring including a connector sleeve coaxially receiving said pump, said connector sleeve having a first axial end and a second axial end opposite said first axial end;

said first axial end engaging a pump flange of the pump;

a retaining ring including a fastener attachable to said first axial end, said retaining ring clamping said pump flange of the pump between said first axial end and said retaining ring;

said retaining ring having an annular channel seating a spring between said pump and said nozzle flange; and said second axial end including a fastener attaching said second axial end to the collapsible container.

9. The dispenser of claim 8, wherein at least a portion of the main body of the pump is received within the collapsible container.

10. The dispenser of claim 9, further comprising:

a spring coaxially received about said nozzle and having a first end seated in said annular channel of the retaining ring and a second end bearing against said nozzle flange and urging said pump to a closed position.

11. The dispenser of claim 10, further comprising:

a cap removably attached to said retaining ring and covering said nozzle.

12. The dispenser of claim 8, further comprising:

a dip sleeve defining an opening receiving said pump inlet and having one or more channels formed in a wall of said opening defining a flow passageway between the collapsible container and the pump inlet, said one or more channels displaced with respect to said longitudinal axis.

13. The dispenser of claim 8, wherein said adapter ring includes a flange adapted to be removably received in said inclined slot.

14. The dispenser of claim 13, further comprising:

one or more flexible spring arms attached to said adapter ring flange; and a latch member on each of said one or more spring arms removably engaging the inclined slot when the pump is received in said nest.

15. The dispenser of claim 14, further comprising:

each of said flexible spring arms including a protrusion which engages a complimentary feature within said inclined slot.

16. The dispenser of claim 15, wherein said protrusion has generally tapered shape which facilitates sliding movement of said protrusion past said complimentary feature in a first direction when a pump is placed in said nest and which resists sliding movement of said protrusion past said complimentary feature in a second direction opposite the first direction.

17. The dispenser of claim 8, further comprising:

an annular sealing ring disposed between said pump flange and said first axial end.

* * * * *